US005945909A

United States Patent [19]

Kolton

[11] Patent Number: 5,945,909

[45] Date of Patent: Aug. 31, 1999

[54] ARTICLE IDENTIFICATION AND SURVEILLANCE SEAL

[75] Inventor: Chester Kolton, Westfield, N.J.

[73] Assignee: B&G Plastics, Inc., Newark, N.Y.

[21] Appl. No.: 09/088,839

[22] Filed: Jun. 2, 1998

[51] Int. Cl.[6] ..... G08B 13/14

[52] U.S. Cl. ..... 340/572.1; 340/568.1; 340/571; 340/572.8; 340/572.9; 340/573.4

[58] Field of Search ..... 340/572.1, 571, 340/572.2, 572.3, 572.9, 573.4, 572.8, 568.1

[56] References Cited

U.S. PATENT DOCUMENTS

| | | | |
|---|---|---|---|
| 4,603,326 | 7/1986 | Freed | 340/572 |
| 5,006,830 | 4/1991 | Merritt | 340/573 |
| 5,524,463 | 6/1996 | Schenkel et al. | 340/572 |
| 5,601,188 | 2/1997 | Dressen et al. | 206/308.2 |
| 5,647,106 | 7/1997 | Hogan | 24/704.1 |
| 5,717,382 | 2/1998 | Cooper | 340/572 |

*Primary Examiner*—Edward Lefkowitz
*Assistant Examiner*—Davetta Woods
*Attorney, Agent, or Firm*—Robin, Blecker & Daley

[57] ABSTRACT

A seal comprises a one-piece body having first and second members closable one upon the other and a tail peripherally continuous with at least one of the first and second members and having a hook at a free end thereof, the seal body defining an interior recess and a detent for retentive reception of the tail hook, an EAS marker being disposed in the recess and contained therein upon closure of the first and second members. The seal body may further include a hinge section connected to the first and second members, whereby the first and second members are hingeably closable.

27 Claims, 3 Drawing Sheets

ARTICLE IDENTIFICATION AND SURVEILLANCE SEAL

FIELD OF THE INVENTION

This invention relates generally to article identification and protection and pertains more particularly to seals having theft-deterrent capability.

BACKGROUND OF THE INVENTION

For purposes of indicating marketing parameters, e.g. manufacturer, price, size and the like, one current practice is to use a so-called "swift tag" involving a plastic filament which is passed through an opening in a tag bearing the marketing parameters and through a garment or the like and is then secured at filament ends to remain with the garment until the filament is cut apart at checkout.

One of applicant's fields of endeavor has been so-called "folding tail" hangers for the display of belts, ties and the like. Article identification data and logo are typically embossed on a main body portion of folding tail hangers. One such folding tail hanger is discussed and shown in U.S. Pat. No. 5,005,741. A characteristic of this type of hanger not found in prior folding tail hangers is that, when the tail is applied to an article and the tail projection inserted into the main body opening for latching the tail to the main body, a conical main body part extending rearwardly of the main body rear surface continues the opening and so retains the tail projection that tail is not separable from the main body without cutting activity. This type of hanger is accordingly referred to as a "security" hanger. A practice of one major retailer is to require all articles adapted to be hung by security hangers be so displayed.

One type of article identification device having security aspects and having virtual universal applicability to articles is the so-called "seal", such as is shown in Mainetti U.S. Pat. No. 5,306,055. The seal of the '055 patent comprises a plastic body having a flexible cord passing through and secured in the body and extending outwardly of the body to a cord free end which has hooks secured thereto and of configuration providing for irreversible insertion in the plastic body. In addition to the body and the cord, the seal of the '055 patent has plates bearing logo/article indication applied to the plastic body to close the same. In use, the hook and cord are passed through an opening of, e.g., a watch band, and the hook is then inserted into the plastic body.

A widespread further practice in article security is the use of so-called anti-theft tags which incorporate electronic article surveillance (EAS) markers. Such tags are secured to articles and are removed or rendered inactive at checkout. Where fraudulent avoidance of checkout (shop-lifting) occurs, the markers are sensed by EAS systems, e.g., at store exits, and suitable alarm is generated.

One form of EAS marker in widespread use is in the form of a flat, thin, flexible, rectangular member which is applied adhesively to flat or curved surfaces of articles. The major retailer referred to above decided further to require that EAS markers be applied to various articles to reduce losses due to shoplifting.

Applicant came to recognize a failure of the foregoing described available article indicators to meet the last-mentioned major retailer requirement.

SUMMARY OF THE INVENTION

The present invention has as its primary object the provision of an article indicator which overcomes such prior art failure.

In attaining such object, applicant conceived of the invention described in detail hereinafter which is fundamentally a seal containing an EAS marker. Thereafter, he conveyed his concept to a party having extensive manufacturing capacity and commercialization of seals, i.e., Mainetti Corporation, the assignee of the above-discussed seal of the '055 patent. Personnel of this corporation and applicant thereafter conceived of a further form of seal with an EAS marker, which is the subject of Italian Patent No. V197A000188, filed on Nov. 6, 1977 and entitled "Anti-Shoplifting Seal".

In more detail, applicant provides in the subject invention, a seal having a one-piece body having first and second members hingeably interconnected so as to be closable one upon the other and a tail peripherally continuous with at least one of the first and second members and having a hook at a free end thereof. The first and second members jointly define an interior recess upon closure thereof and at least one thereof defines a detent for retentive reception of the tail hook. The recess is dimensioned for the receipt of an EAS marker, which is assembled with the one-piece body prior to closure of the first and second members.

The body may include plural, separate recesses where the EAS marker and a component, e.g., a semiconductor chip, associated therewith are to be accommodated.

The invention will be further understood from consideration of the following description of preferred embodiments thereof and from the drawings where like reference numerals identify like parts throughout.

DETAILED DESCRIPTION OF PREFERRED EMBODIMENTS

Figure 1:
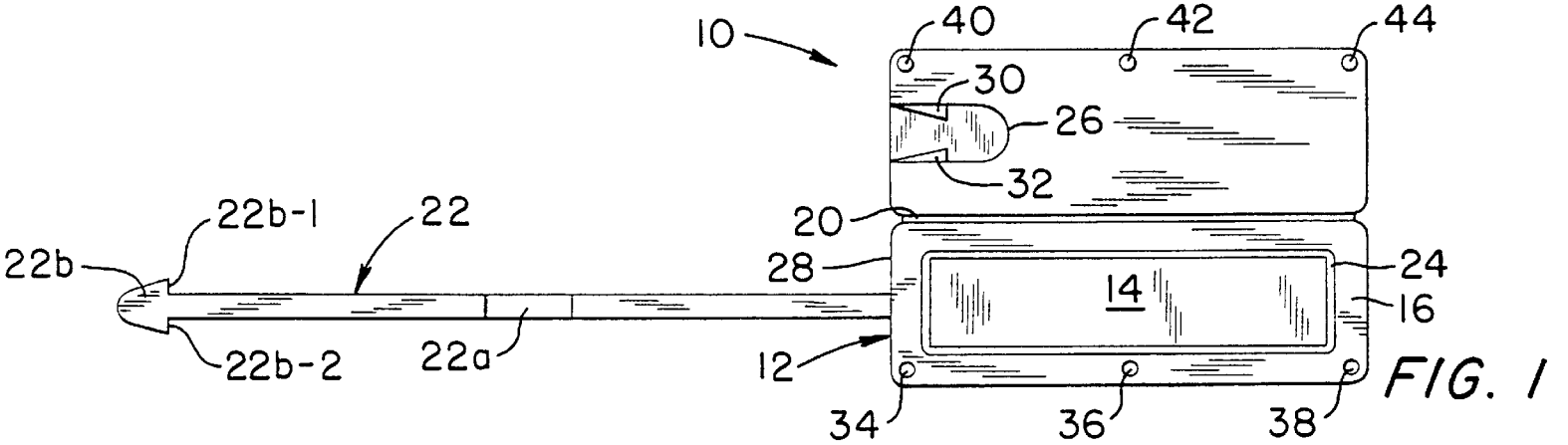
FIG. 1 is a plan view of a first embodiment of a seal in accordance with the invention in its open state.
Figure 2:
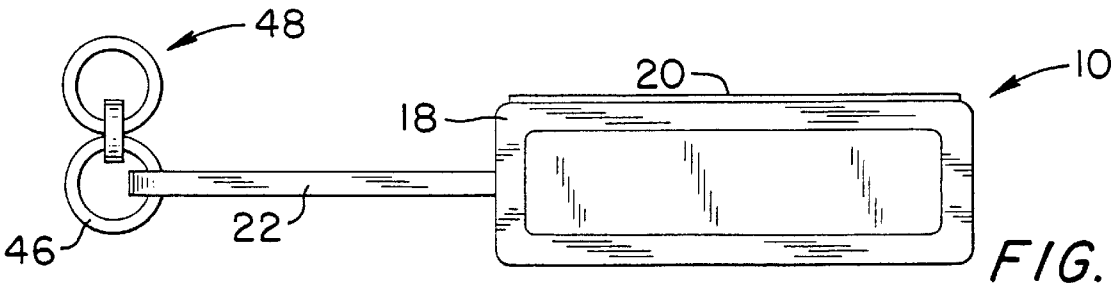
FIG. 2 is a plan view of the FIG. 1 seal in its closed state and attached to a link of a bracelet.
Figure 3:
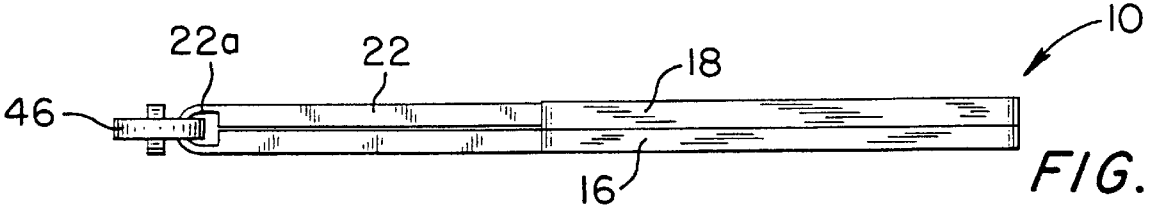
FIG. 3 is a front elevation of the FIG. 2 assembly.

Referring to FIGS. 1–4, seal 10 is constituted as a one-piece body 12 of molded plastic and an insert 14, comprising an EAS marker, e.g., a ferromagnetic member. Seal body 12 is thus comprised of a material which permits detection of the EAS marker.

Seal body 12 includes first and second members 16 and 18, hingeably interconnected by hinge section 20, so as to be closable one upon the other.

Tail 22, unlike the cords of heretofore known seals, is an integral component of seal 10, being continuous with and extending exteriorly of first member 16. Tail 22 includes a thinned-out portion 22*a*, defining a fold segment for the tail, and has a hook 22*b* formed at a free end of the tail.

A recess 24 is formed in first member 16 of dimensions at least equal to the dimensions of EAS marker 14 so as to receive the same and, with second member 18 then closed upon first member 16, to contain the marker and not evidence that the seal has EAS—anti-shoplifting characteristics.

Detent 26 is formed in second member 18, opening into the same side 28 of seal body 10 from which tail 22 extends exteriorly of first member 16. Claws 30 and 32 serve to retain hook 22*b* upon insertion thereof into the detent, abutting with hook surfaces 22*b*-1 and 22*b*-2.

Figure 4:
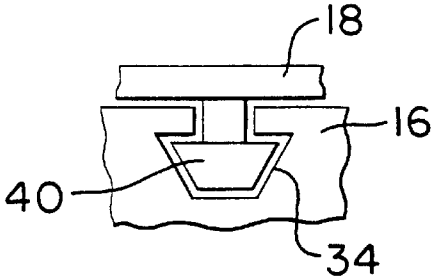
FIG. 4 is an enlarged partial view of the FIG. 2 assembly.

Openings 34, 36 and 38 are formed in the upper surface of first member 16 and projections 40, 42 and 44 extend outwardly of second member 18. FIG. 4 illustrates a preferred configuration of the openings and projections, wherein there is a joinder of first member 16 and second member 18.

In use of seal 10, following insertion of the EAS marker into the seal recess, tail 22 is inserted through an article to be protected, e.g. link 46 of bracelet 48, and then tail 22 is folded and hook 22*b* is inserted into detect 28. In the first embodiment, article identification data, bar code and the like are applied to outer sides of either or both of first and second members 16 and 18.

Figure 5:
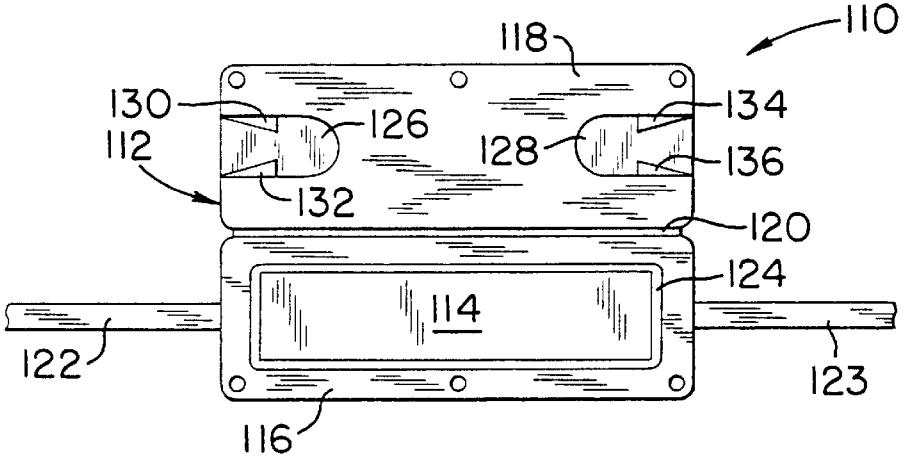
FIG. 5 is a partial plan view of a second embodiment of a seal in accordance with the invention in its open state.
Figure 6:
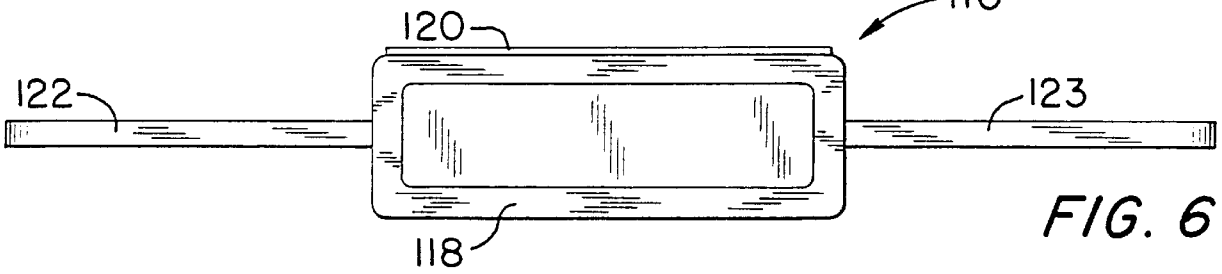
FIG. 6 is a plan view of the FIG. 5 seal in its closed state.
Figure 7:
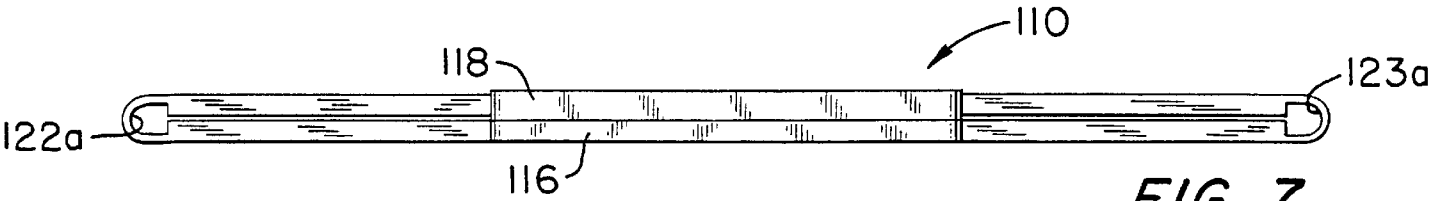
FIG. 7 is a front elevation of the FIG. 6 assembly.

Referring to FIGS. 5–7, seal 110 is constituted as a one-piece body 112 of molded plastic and an insert 114, comprising an EAS marker, e.g., a ferromagnetic member. Seal body 112 is thus comprised of a material which permits detection of the EAS marker.

Seal body 112 includes first and second members 116 and 118, hingeably interconnected by hinge section 120, so as to be closable one upon the other.

Tails 122 and 123, likewise unlike the cords of heretofore known seals, are integral components of seal 110, being continuous with and extending exteriorly of first member 116. Tails 122 and 123 include thinned-out portions 122*a* and 123*a,* defining fold segments for the tails, and have hooks (not shown) formed at free ends of the tails.

Recess 124 is formed in first member 116 of dimensions at least equal to the dimensions of EAS marker 114 so as to receive the same and, with second member 118 then closed upon first member 116, to contain the marker and not evidence that the seal has EAS—anti-shoplifting characteristics.

Detents 126 and 128 are formed in second member 118, opening into the same sides of seal body 112 from which tails 122 and 123 extend exteriorly of first member 116. Claws 130, 132, 134 and 136 serve to retain the hooks of tails 122 and 123 upon insertion thereof into the detents.

In use of seal 110, following insertion of the EAS marker into the seal recess, tail 122 is inserted through an article to be protected, e.g. link 146 of bracelet 148 (FIGS. 2 and 3), and then tail 122 is folded and its hook is inserted into detect 126. In the second embodiment under discussion, article identification data, bar code and the like are applied to a tag. Tail 123 is inserted through the tag and then tail 123 is folded and hook 123*b* is inserted into detect 128.

Figure 8:
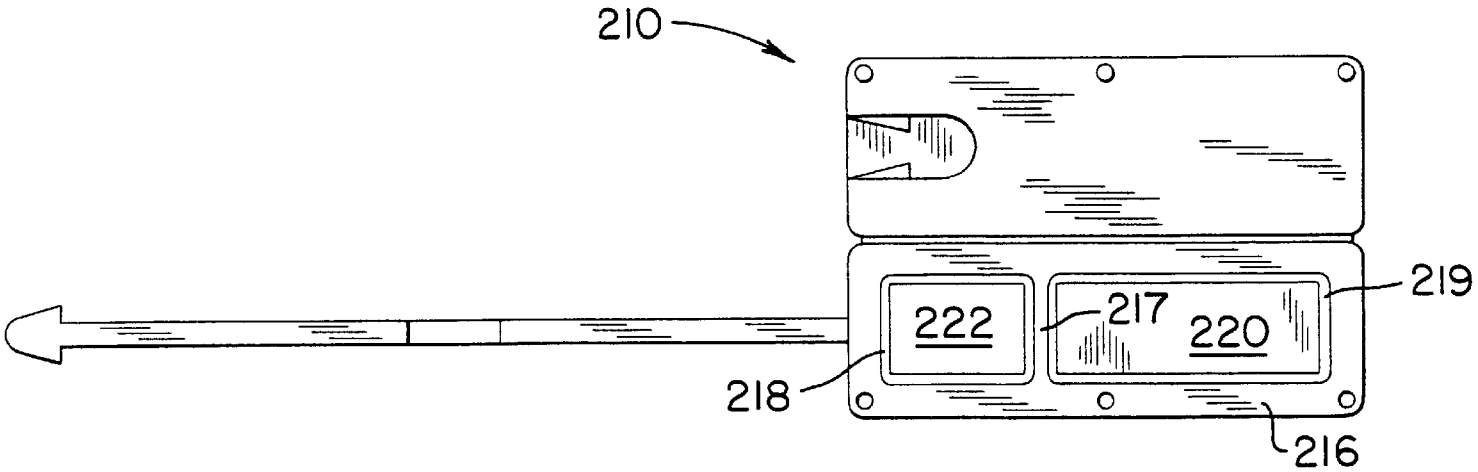
FIG. 8 is a plan view of a third embodiment of a seal in accordance with the invention in its open state.

Turning to FIG. 8, seal 210 is configured as in the first embodiment other than for the fact that its first member 216 includes a divider 217 providing separate recesses 218 and 219. EAS marker 220 is disposed in recess 219 and a chip 222 is disposed in recess 218.

Various changes may be introduced in the disclosed preferred embodiments without departing from the invention. For example, while the tails are shown as extending from the seal member defining the EAS member recess, the tails may extend from either or both members. Further, the EAS member recess may be formed in either or both members. Still further, the first and second embodiments may include plural recesses as per the third embodiment. Accordingly, it is to be appreciated that the true spirit and scope of the invention is set forth in the following claims.

What is claimed is:

1. A seal comprising a one-piece body having first and second members closable one upon the other and thereupon respectively defining first and second outer seal walls and a tail peripherally continuous with at least one of the first and second members at a third outer seal wall and having a hook at a free end thereof, said seal body defining an interior recess and a detent opening into said third outer seal wall for retentive reception of the tail hook interiorly of said seal, an EAS marker being disposed in said recess and contained therein between said first and second outer seal walls upon closure of said first and second members.

2. The seal claimed in claim 1, wherein said seal body includes a hinge section connected to said first and second members, whereby said first and second members are hingeably closable.

3. The seal claimed in claim 1, wherein said first and second members define mutually engageable means for retaining said first and second members in closed condition.

4. The seal claimed in claim 2, wherein said first and second members define mutually engageable means for retaining said first and second members in closed condition.

5. The seal claimed in claim 1, wherein said recess is formed in one of said first and second members.

6. The seal claimed in claim 1, wherein said tail extends from one of said first and second members.

7. The seal claimed in claim 1, wherein said recess is formed in said first member and wherein said tail extends from said second member.

8. The seal claimed in claim 2, wherein said recess is formed in one of said first and second members.

9. The seal claimed in claim 2, wherein said tail extends from one of said first and second members.

10. The seal claimed in claim 2, wherein said recess is formed in said first member and wherein said tail extends from said second member.

11. The seal claimed in claim 3, wherein said recess is formed in one of said first and second members.

12. The seal claimed in claim 3, wherein said tail extends from one of said first and second members.

13. The seal claimed in claim 3, wherein said recess is formed in said first member and wherein said tail extends from said second member.

14. A seal comprising a one-piece body having first and second members closable one upon the other and thereupon respectively defining first and second outer seal walls and first and second tails peripherally continuous with at least one of the first and second members at respective third and fourth outer seal walls and each having a hook at a free end thereof, said seal body defining an interior recess and first and second detents opening respectively into said third and fourth outer seal walls for retentive reception of the tail hooks interiorly of said seal, an EAS marker being disposed in said recess and contained therein between said first and second outer seal walls upon closure of said first and second members.

15. The seal claimed in claim 14, wherein said seal body includes a hinge section connected to said first and second members, whereby said first and second members are hingeably closable.

16. The seal claimed in claim 14, wherein said first and second members define mutually engageable means for retaining said first and second members in closed condition.

17. The seal claimed in claim 15, wherein said first and second members define mutually engageable means for retaining said first and second members in closed condition.

18. The seal claimed in claim 14, wherein said recess is formed in one of said first and second members.

19. The seal claimed in claim 14, wherein said tails extend from one of said first and second members.

20. The seal claimed in claim 14, wherein said recess is formed in said first member and wherein said tails extend from said second member.

21. The seal claimed in claim 15, wherein said recess is formed in one of said first and second members.

22. The seal claimed in claim 15, wherein said tail extends from one of said first and second members.

23. The seal claimed in claim 15, wherein said recess is formed in said first member and wherein said tails extend from said second member.

24. The seal claimed in claim 16, wherein said recess is formed in one of said first and second members.

25. The seal claimed in claim 16, wherein said tails extend from one of said first and second members.

26. The seal claimed in claim 16, wherein said recess is formed in said first member and wherein said tails extend from said second member.

27. A seal comprising a one-piece body having first and second members closable one upon the other and thereupon respectively defining first and second outer seal walls and a tail peripherally continuous with at least one of the first and second members at a third outer seal wall and having a hook at a free end thereof, said seal body defining first and second recesses and a detent opening into said third outer seal wall for retentive reception of the tail hook interiorly of said seal, first and second EAS components being disposed respectively in said first and second recesses and contained therein between said first and second outer seal walls upon closure of said first and second members.

* * * * *